US005735558A

United States Patent [19]

Watanabe

[11] Patent Number: 5,735,558

[45] Date of Patent: Apr. 7, 1998

[54] APPARATUS FOR MOUNTING A LATCH DEVICE TO A SLIDING DOOR

[75] Inventor: Hrofumi Watanabe, Yamanashi-ken, Japan

[73] Assignee: Mitsui Kinzoku Kogyo Kabushiki Kaisha, Tokyo, Japan

[21] Appl. No.: 654,001

[22] Filed: May 28, 1996

Related U.S. Application Data

[63] Continuation of Ser. No. 368,955, Jan. 5, 1995, abandoned.

[30] Foreign Application Priority Data

Jan. 11, 1994 [JP] Japan ..... 6-013197

[51] Int. Cl.[6] ..... E05B 9/00

[52] U.S. Cl. ..... 292/337; 292/216; 292/DIG. 23; 292/DIG. 46

[58] Field of Search ..... 292/DIG. 5, DIG. 46, 292/DIG. 23, DIG. 18, DIG. 3, 18, 23, 46, 95–100, 215, 216, 336.3, 337

[56] References Cited

U.S. PATENT DOCUMENTS

| | | | |
|---|---|---|---|
| 2,147,358 | 2/1939 | Smith | 292/DIG. 23 |
| 4,052,094 | 10/1977 | Widën | 292/336.3 |
| 4,457,146 | 7/1984 | Weinerman . | |
| 4,511,166 | 4/1985 | Weinerman . | |
| 4,575,138 | 3/1986 | Nakamura et al. | 292/216 |
| 4,580,823 | 4/1986 | Yamada et al. | 292/340 |
| 4,603,894 | 8/1986 | Osenkowski et al. | 292/216 |
| 4,615,558 | 10/1986 | Nakamura et al. | 296/203 |
| 4,647,092 | 3/1987 | Nakamura | 292/216 |
| 4,838,588 | 6/1989 | Hayakawa et al. | 292/216 |

*Primary Examiner*—Steven N. Meyers
*Assistant Examiner*—Gary Estremsky
*Attorney, Agent, or Firm*—Browdy and Neimark

[57] ABSTRACT

An apparatus for mounting a front latch device to a front side of a sliding door to be closed and opened by moving in front-and-rear direction of a vehicle body comprises a mounting wall to which the front latch device is mounted by screws or bolts. The front latch device is provided with a latch body accommodating a fork member and pawl member, and first and second metal plates mounted to the latch body. The first metal plate is closely adhered onto the mounting wall, and the second metal plate has boss portions to be engaged with ends of the screws or bolts. The latch body sandwiched between the first and second plates. The mounting wall is parallel to a direction in which the front latch device moves.

16 Claims, 4 Drawing Sheets

APPARATUS FOR MOUNTING A LATCH DEVICE TO A SLIDING DOOR

This application is a continuation of application Ser. No. 08/368,955, filed on Jan. 5, 1995, now abandoned.

FIELD OF THE INVENTION

This invention relates to an apparatus for mounting a latch device to a sliding door.

DESCRIPTION OF THE RELATED ART

As illustrated in FIGS. 1 to 4, a conventional sliding door A to be opened and closed by being moved forwardly and backwardly along a guide rail (not shown) of a vehicle body B has a front latch device D which is provided at the front side of the door A and is engaged with a front striker C fixed to the vehicle body B, and also has a rear latch device F which is provided at the rear side thereof and is engaged with a rear striker E fixed to the vehicle body B. The front latch device D consists of a latch body I, in which well known fork member G and pawl member H are contained, and two metal plates J and K which encircle the latch body I. Each of the plates J and K has a pair of flanges N or O fastened to a side wall L of the door A with screws or bolts M.

When closing the sliding door A, the front latch device D first moves in the direction of an arrow Y. Then, just before the door A is completely closed, the front latch device D is slightly turned to the direction of an arrow X, which forms an acute angle with the direction of the arrow Y, and is thus engaged with the front striker C. The side wall L is formed nearly perpendicularly to the direction of the arrow X so that the surface of revolution of the fork member G engaged with the striker C becomes parallel with the direction of the arrow X. However, when the surface of revolution thereof becomes parallel to the direction of the arrow X, the front latch device D is inevitably elongated in the direction of the arrow X. Thus, when an external force acts on an end portion which is distant from the side wall L or the screws M, large stresses are imposed on the flanges N and O, especially, on corner portions P. Therefore, the strengths of the screw and the plate should be increased so that the screws and the plate can withstand the external force. Consequently, the front latch device D has a large size and a heavy weight.

Further, the flanges N and O are provided in and are unique to the front latch device D of the sliding door. Namely, neither a latch device of an ordinary swinging door nor the rear latch device F is provided with such flanges. Consequently, the front latch device D is larger than other latch devices by the flanges N and O.

SUMMARY OF THE INVENTION

Accordingly, an object of the present invention is to provide an apparatus for mounting a latch device to a sliding door, whereby a small and lightweight latch device can be used.

Other features, objects and advantages of the present invention will become apparent from the following description of a preferred embodiment with reference to the drawings in which like reference characters designate like or corresponding parts throughout several views.

DETAILED DESCRIPTION OF THE PREFERRED EMBODIMENTS

Hereinafter, the preferred embodiment of the present invention will be described in detail by referring to the accompanying drawings.

Figure 5:
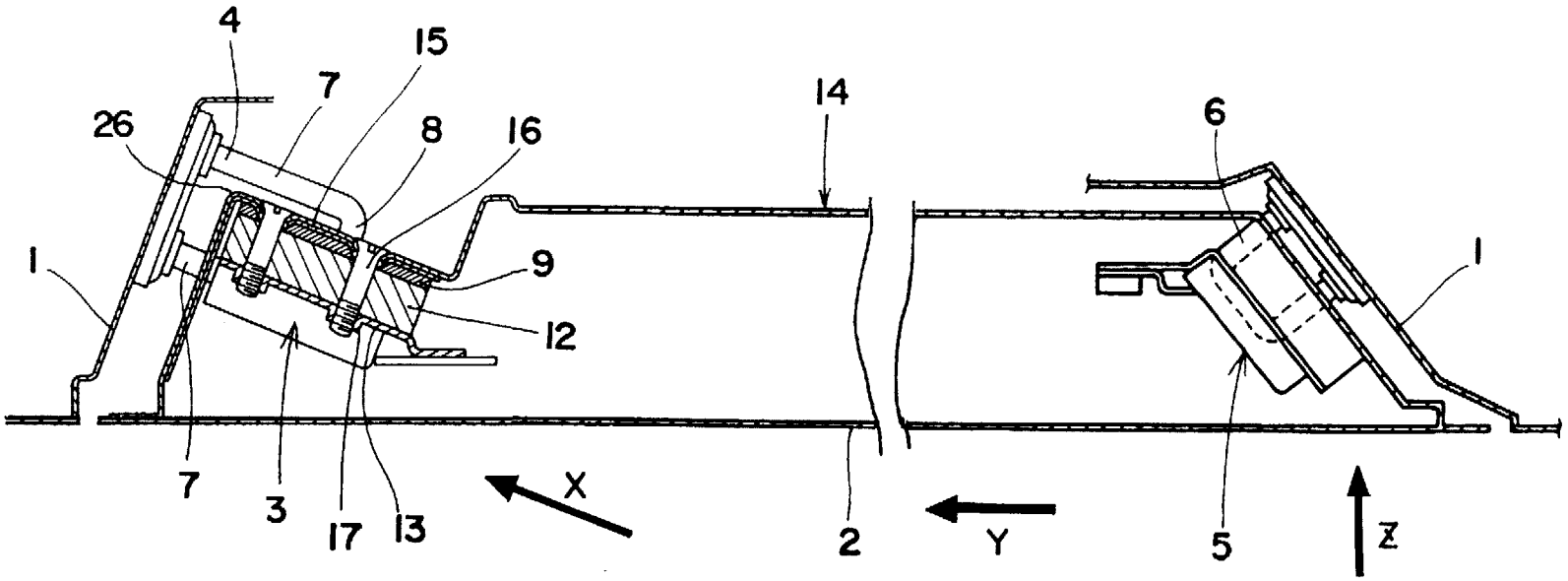
FIG. 5 is a transverse sectional view of a sliding door of the present invention, the central portion of which is broken away.
Figure 6:
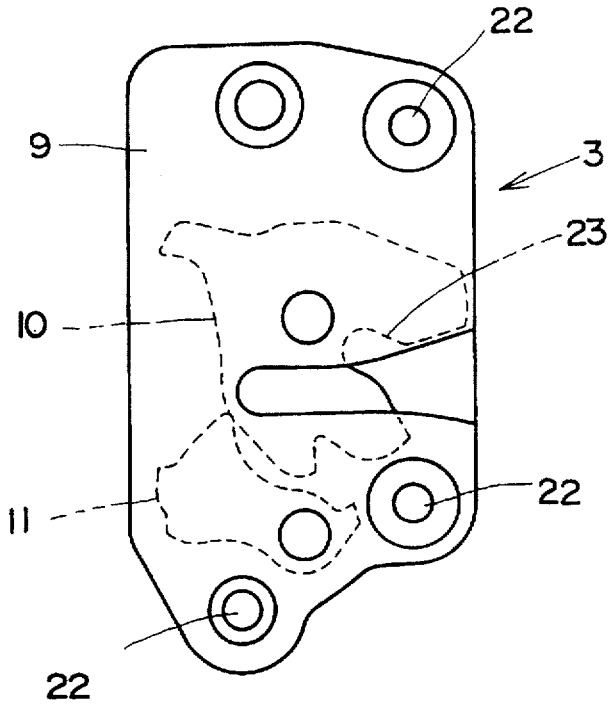
FIG. 6 is a side view of a front latch device of the present invention.
Figure 7:
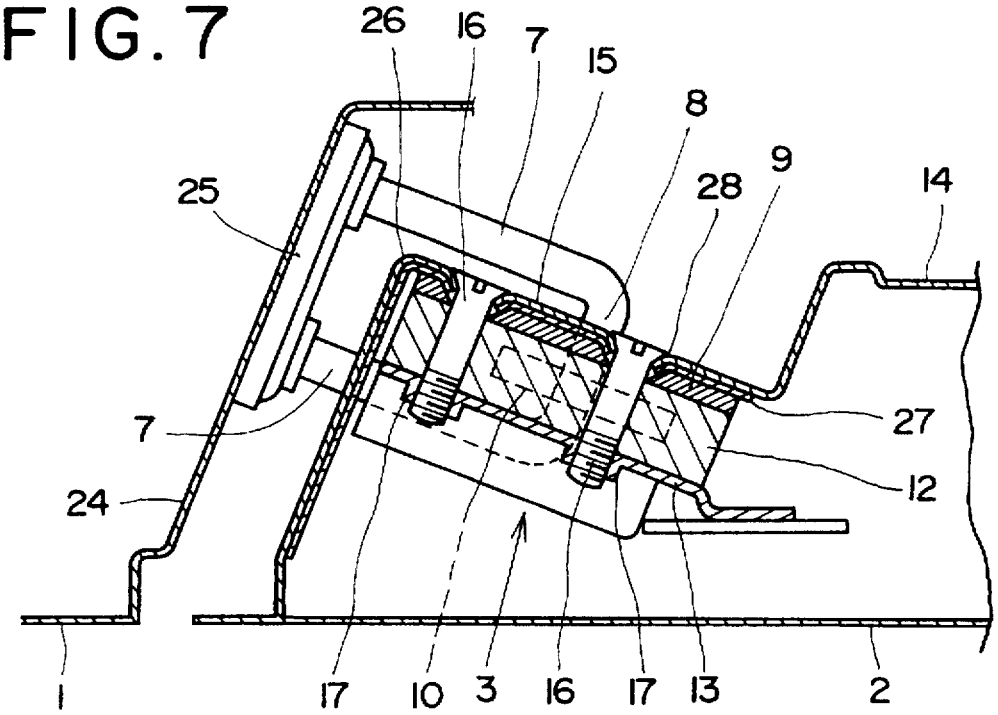
FIG. 7 is an enlarged sectional view for illustrating how the front latch device of the present invention is mounted to the sliding door of the present invention.

As shown in FIGS. 5 to 7, a sliding door 2 which is opened and closed by moving along a guide rail (not shown) of a vehicle body 1 in front-and-rear direction is provided with a front latch device 3 adapted to engage with a front striker 4 secured to the vehicle body 1, and also provided with a rear latch device 5 adapted to engage with a rear striker 6 secured to the vehicle body 1. When closing the sliding door 2, the front latch device 3 first moves in the direction of an arrow Y. Then, just before the door 2 is completely closed, the front latch device 3 is slightly turned to the direction of an arrow X, which forms an acute angle with the direction of the arrow Y, and is thus engaged with the front striker 4. After the front latch device 3 is engaged with the front striker 4, when the door moves in the direction of an arrow Z around an engaging point where the latch device 3 is engaged with the striker 4, the rear latch device 5 is engaged with the rear striker 6.

Figure 1:
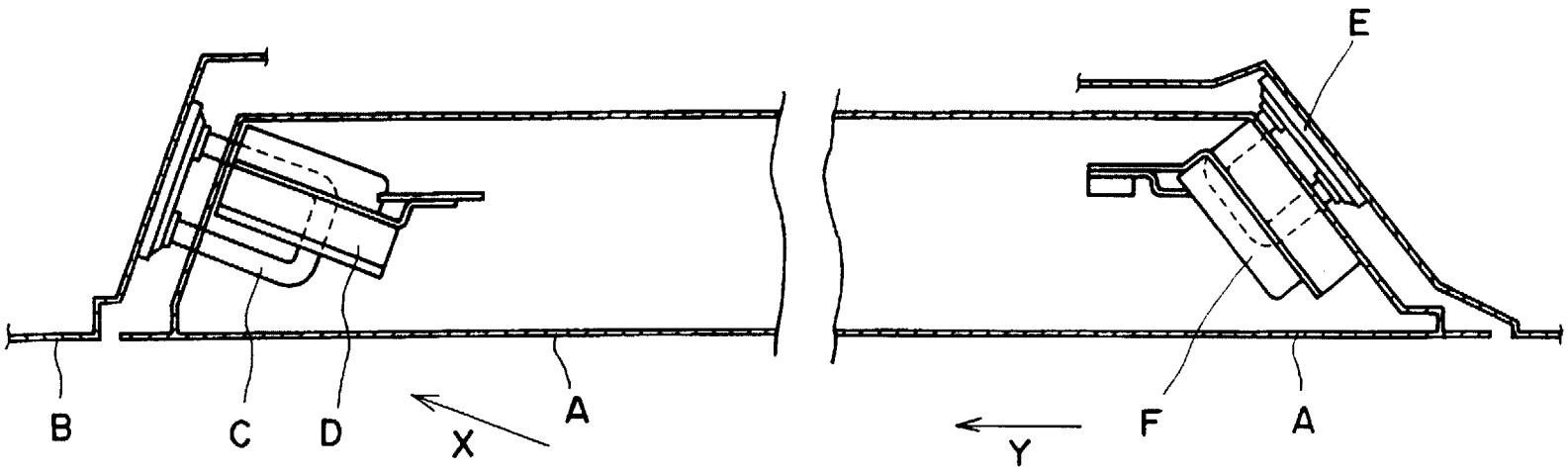
FIG. 1 (PRIOR ART)
FIG. 1 is a transverse sectional view of a conventional sliding door, the central portion of which is broken away.
Figure 2:
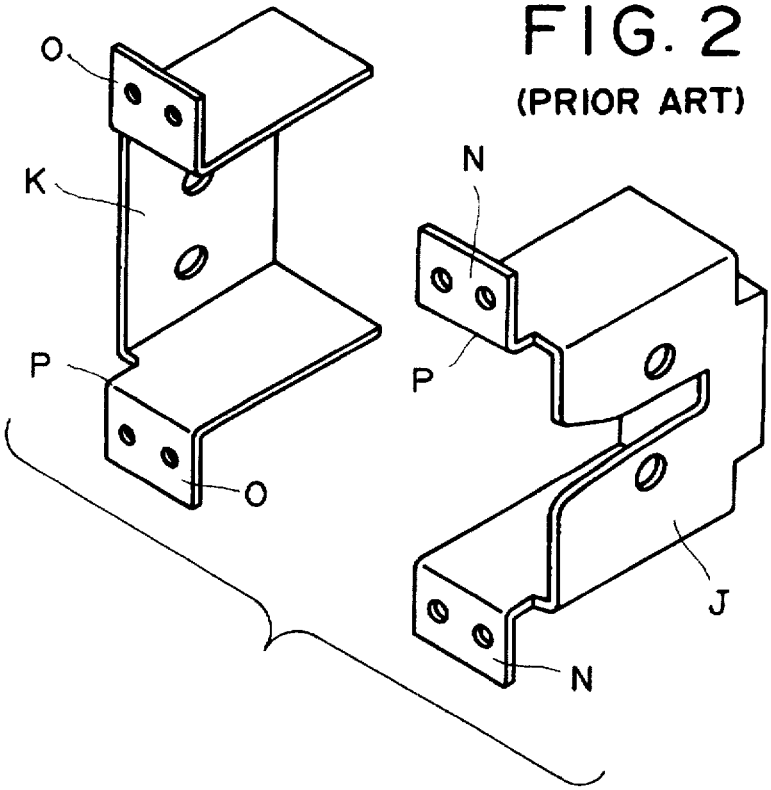
FIG. 2 (PRIOR ART)
FIG. 2 is a perspective view of a pair of plates of a conventional front latch device.
Figure 3:
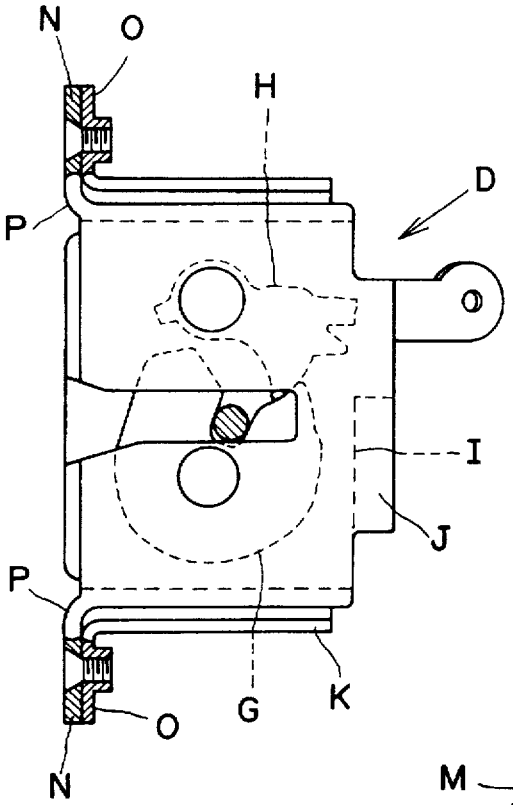
FIG. 3 (PRIOR ART)
FIG. 3 is a side view of the conventional front latch device.
Figure 4:
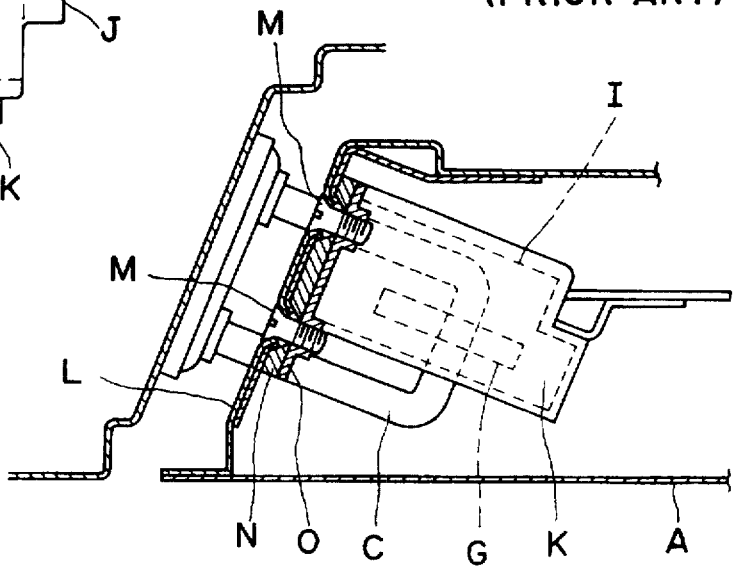
FIG. 4 (PRIOR ART)
FIG. 4 is an enlarged sectional view for illustrating how the conventional front latch device is mounted to the conventional sliding door.

The front latch device 3 has a fork member 10, in which a U-shaped groove 23 engaging with the front striker 4 is formed, and a pawl member 11 for preventing the fork member 10 from reversing. The fork member 10 and the pawl member 11 are enclosed in a latch body 12 made of synthetic resin and are rotatably mounted on shafts 10*a* and 11*a*, respectively. The body 12 is sandwiched between a pair of metal plates 9 and 13. The rear latch device 5 is not unique to this embodiment in view of the conventional rear latch device F of FIG. 1. Therefore, the detailed description of the rear latch device 5 is omitted herein.

The front striker 4 consists of a base portion 25 fastened to a frame 24 of the vehicle body 1 with bolts (not shown), a pair of rods 7, one end of each of which is fixed to the base portion 25, and a rod 8 for coupling ends of the rods 7 to each other. The rod 8 which is adapted to engage with a U-shaped groove 23 of the fork member 10 is placed approximately perpendicularly to the direction of the arrow X.

A mounting wall or panel 15 being parallel to X-direction is formed in a front corner portion 26 of the sliding door 2 by denting an inner wall or panel 14 of the sliding door 2. In the illustrated embodiment, the front latch device 3 has holes 22, and the mounting wall 15 has holes 28. Screws or bolts 16 are inserted through these holes and fastened in place. Almost the entire surface of the plate 9 of the front latch device 3 is closely adhered onto the mounting wall 15 as illustrated in FIG. 7. Each screw 16 has a length sufficient to pierce through the latch device 3, and each tip end of the screws 16 is screwed into a boss portion or a nut 17 formed in the plate 13.

As described above, the surface of revolution of the fork member 10 is parallel with the direction of the arrow X, so that the front latch device 3 of the present invention is elongated in the direction of the arrow X similarly as in the case of the conventional latch device D illustrated in FIGS. 1 to 4. However, in the case of the front latch device 3 of the present invention, nearly the entire surface of the plate 9 is closely adhered to the mounting wall 15. Thus the front latch device 3 does not have an unstable end portion at a distance from the mounting wall 15. Therefore, as compared with the prior art latch device D, the front latch device 3 is more resistant to great external force as would be exerted thereon in an automobile accident or the like. Moreover, in the case of the front latch device 3 of the present invention, the screws 16 pierce therethrough. Therefore, the front latch device 3 has no means being equivalent to the flanges N and O of FIG. 3. Consequently, a small and lightweight front latch device 3 can be realized.

Incidentally, similarly as in the case of the conventional device, a reinforcement plate 27 may be provided between the mounting wall 15 and the plate 9.

The mounting wall 15 is formed perpendicularly to the engaging rod 8, so that when the sliding door 2 is completely closed, the surface of revolution of the fork portion 10 of the front latch device 3 meets at right angles with the engaging rod 8 as illustrated in FIG. 7. Thereby, the engagement between the fork member 10 and the rod 8 is smoothly achieved.

Although the preferred embodiment of the present invention has been described above, it should be understood that the present invention is not limited thereto and that other modifications will be apparent to those skilled in the art without departing from the spirit of the invention.

The scope of the present invention, therefore, is to be determined solely by the appended claims.

What is claimed is:

1. A sliding door mounted to a vehicle body and slidable in a first direction parallel to an outer surface of the vehicle body, said sliding door comprising, an outer panel, and inner panel opposite to said outer panel, a side panel connecting said outer panel and said inner panel, a front corner formed between the inner panel and the side panel and a mounting wall formed in a front side portion of the inner panel adjacent to the front corner, a front latch device mounted to said mounting wall and engageable with a front striker fixed to a surface of the vehicle body, said side panel being opposite to said surface on which the front striker is fixed, said door being movable in a second direction at an acute angle to the first direction when the front latch device is engaged with the front striker, and the front latch device mounted to the mounting wall by screws or bolts, wherein said mounting wall is formed at an acute angle to the first direction and in parallel to the second direction.

2. The sliding door according to claim 1, wherein said striker has an engaging rod engageable with the front latch device, wherein said engaging rod is perpendicular to the second direction and parallel to a surface on the vehicle to which the engaging rod is fixed.

3. The sliding door according to claim 1, wherein an axis of each said screws or bolts is at a right angle to the second direction.

4. The sliding door according to claim 3, wherein each of said screws or bolts has a length sufficient to pierce through the front latch device.

5. The sliding door according to claim 3, wherein said front latch device is provided with a fork member adapted to engage with the striker, a pawl member for preventing the fork member from reversing, a latch body accommodating the fork member and pawl member, wherein said fork member and pawl member are rotatably supported by shafts which are parallel to the axis of each of said screws or bolts.

6. The sliding door according to claim 5, wherein said striker has an engaging rod engageable with the fork member, wherein said engaging rod is perpendicular to the second direction.

7. A sliding door mounted to a vehicle body and slidable in a first direction parallel to an outer surface of the vehicle body, said sliding door comprising, an outer panel, an inner panel opposite to said outer panel a side panel connecting said outer panel and said inner panel, a front corner formed between the inner panel and the side panel and a mounting wall formed in a front side portion of the inner panel adjacent to the front corner, a front latch device mounted to said mounting wall and engageable with a front striker fixed to the vehicle body, said side panel being opposite to said surface on which the first striker is fixed, a rear latch device mounted to a rear edge portion of the door and engageable with a rear striker fixed to the vehicle body, said door being movable in a second direction at an acute angle to the first direction when the front latch device is engaged with the front striker and in a third direction at about a right angle to the first direction when the rear latch device is engaged with the rear striker, and the front latch device mounted to the mounting wall by screws or bolts, wherein said mounting wall is formed at an acute angle to the first direction and in parallel to the second direction.

8. The sliding door according to claim 7, wherein said striker has an engaging rod engageable with the front latch device, wherein said engaging rod is perpendicular to the second direction and parallel to a surface on the vehicle to which the engaging rod is fixed.

9. The sliding door according to claim 7, wherein an axis of each of the screws or bolts is at right angles with the second direction.

10. The sliding door according to claim 9, wherein each of the screws or bolts has a length sufficient to pierce through the front latch device.

11. The sliding door according to claim 9, wherein the front latch device is provided with a fork member adapted to engage with the striker, a pawl member for preventing the fork member from reversing, a latch body accommodating the fork member and pawl member, wherein said fork member and pawl member are rotatably supported by shafts which are parallel to the axis of each of the screws or bolts.

12. The sliding door according to claim 11, wherein said striker has an engaging rod engageable with the fork member, wherein said engaging rod is perpendicular to the second direction.

13. A sliding door mounted to a vehicle body to be closed and opened by moving in a front-and-rear direction in parallel to an outer surface of a vehicle body during initial movement of the door to its closed position and moving in a second direction at an acute angle to the first direction during a final movement of the door toward the closed position, said sliding door having an outer panel, an inner panel opposite to said outer panel, a side panel connecting said outer panel and said inner panel, a front corner formed between the inner panel and the side panel and a mounting wall formed in a front side portion of the inner panel adjacent to the front corner, a front latch device mounted to said mounting wall, said sliding door further comprising; the front latch device mounted to the mounting wall by screws or bolts, wherein said mounting wall is formed at an acute angle that is parallel to the second direction so that a side of the front latch device is parallel to the mounting wall when engaging a striker fixed to the vehicle body, wherein said striker has a pair of rods each having a first end fixed to the vehicle body and a second end fixed to an engaging rod, said engaging rod being perpendicular to the side of the front latch device when engaging the front latch device and parallel to a surface on the vehicle to which the pair of rods are fixed.

14. The sliding door according to claim 13, wherein an axis of said screws or bolts is at right angles to the second direction.

15. The sliding door according to claim 13, wherein each of said screws or bolts has a length sufficient to pierce through the front latch device.

16. The sliding door according to claim 13, wherein said front latch device is provided with a fork member adapted to engage with the striker, a pawl member for preventing the fork member from reversing, a latch body accommodating the fork member and pawl member, wherein said fork member and pawl member are rotatably supported by shafts which are parallel to the axis of each of the screws or bolts.

* * * * *